US010878647B2

(12) United States Patent
Kane

(10) Patent No.: US 10,878,647 B2
(45) Date of Patent: Dec. 29, 2020

(54) METHOD AND SYSTEM FOR SECURELY RECEIVING DELIVERIES

(71) Applicant: Jacqueline Kane, Atlantic Beach, FL (US)

(72) Inventor: Jacqueline Kane, Atlantic Beach, FL (US)

( * ) Notice: Subject to any disclaimer, the term of this patent is extended or adjusted under 35 U.S.C. 154(b) by 0 days.

(21) Appl. No.: 16/459,550

(22) Filed: Jul. 1, 2019

(65) Prior Publication Data

US 2020/0035051 A1 Jan. 30, 2020

Related U.S. Application Data

(60) Provisional application No. 62/712,114, filed on Jul. 30, 2018.

(51) Int. Cl.

| | |
|---|---|
| ***G07C 9/00*** | (2020.01) |
| ***G07C 9/21*** | (2020.01) |
| ***G07C 9/28*** | (2020.01) |
| ***A47G 29/14*** | (2006.01) |

(52) U.S. Cl.

CPC ..... *G07C 9/00912* (2013.01); *A47G 29/141* (2013.01); *G07C 9/21* (2020.01); *G07C 9/28* (2020.01); *G07C 2009/00928* (2013.01)

(58) Field of Classification Search

CPC ..... G07C 9/00912; G07C 9/21; G07C 9/28; G07C 2009/00928; A47G 29/141

See application file for complete search history.

(56) References Cited

U.S. PATENT DOCUMENTS

2003/0179075 A1* 9/2003 Greenman ..... G07C 9/00896 340/5.54
2014/0190081 A1* 7/2014 Wanjohi ..... E06B 1/52 49/25
2016/0066733 A1* 3/2016 Gozar ..... A47G 29/141 232/18
2016/0331171 A1* 11/2016 Jiang ..... G06Q 10/0833
2018/0199745 A1* 7/2018 Charbeneau ..... A47G 29/22

* cited by examiner

*Primary Examiner* — Nabil H Syed

(74) *Attorney, Agent, or Firm* — Wilson Dutra, PLLC; Camille A. Wilson

(57) ABSTRACT

The present disclosure relates generally to a system and method for receiving packages through the mail when a person is not home. More specifically, the present disclosure provides a system for a person to facilitate safe and secure delivery to a receiving module without needing to be present. In some aspects, an administrator may control the module from a portable smart device or other wireless device. The receiving module may be operated digitally, manually, virtually, or combinations thereof. The settings of the receiving module may be controlled by a recipient, delivery service, sender, or combinations thereof. In some embodiments, the receiving module may be installable on a garage door.

18 Claims, 13 Drawing Sheets

METHOD AND SYSTEM FOR SECURELY RECEIVING DELIVERIES

CROSS-REFERENCE TO RELATED APPLICATION

This application claims priority to and the full benefit of U.S. Provisional Patent Application Ser. No. 62/712,114, filed Jul. 30, 2018, and titled "METHOD AND SYSTEM FOR SECURELY RECEIVING DELIVERIES", the entire contents of which are incorporated in this application by reference.

BACKGROUND OF THE DISCLOSURE

Before the advent of the internet, a person did most of their shopping in a brick and mortar store and brought their purchases home with them. As the convenience of internet retail grew, more people started incorporating online shopping into their daily lives. A December 2016 study revealed that 8 in 10 of U.S. consumers shop online, either through the internet or through mobile devices. Individuals can order a variety of products to their doorstep, which may include a variety of products ranging from clothing to furniture to groceries.

A byproduct of online shopping is that consumers mainly have their purchases delivered to their businesses or places of residence. These deliveries often occur when the resident is not home, which results in the package being left outside the person's door until they get home and can take the package in. In 2017, families received an average of 27 packages per year in the US. As home delivery increased, so did package theft. 11 million homeowners had a package stolen in 2016, while 53% of homeowners worry about their packages being stolen. On average, 74% of packages are stolen during the day when homeowners are at work.

Some packages require the owner to be present for delivery, such as for a signature. While this prevents package theft, it may cause a substantial delay or inconvenience since the recipient has to be physically present to sign for the package or travel to the local post office to pick it up. This process disrupts the convenience of home delivery and discourages consumers from online shopping.

Most packages are delivered outside a home or an apartment door, sitting unattended until a resident returns home. In apartment complex hallways or home neighborhoods without surveillance, there is nothing to stop a passerby from stealing the packages. As a result, millions of homeowners experience package theft every year. Though there have been some solutions for reducing package theft, there is still a need for package recipients to control the receipt of packages without worrying about theft or pick-up.

SUMMARY OF THE DISCLOSURE

What is needed is a device that may facilitates and enables secure receipt of packages even when a recipient may not be able to personally accept the package. The present disclosure relates generally to a system and method for receiving packages through a delivery service when a person is not home. More specifically, the present disclosure provides a system for a person to facilitate safe and secure delivery to a manually controlled module without needing to be present.

According to the present disclosure, an administrator may control the module from a portable smart device. In the following sections, detailed descriptions of examples and methods of the disclosure will be given. The description of both preferred and alternative examples, though thorough, are exemplary only, and it is understood that, to those skilled in the art, variations, modifications, and alterations may be apparent. It is therefore to be understood that the examples do not limit the broadness of the aspects of the underlying disclosure as defined by the claims.

The present disclosure relates to a receiving module for receiving packages, the receiving module comprising: a receiving opening for receiving an expected package; a receiving panel, wherein the receiving panel controls access to the receiving opening; a locking mechanism that secures the receiving panel, wherein when the receiving panel may be secured, the receiving opening may not be accessible; and a security panel that controls the locking mechanism.

Implementations may comprise one or more of the following features. In some aspects, the receiving module may be installable on an exterior wall of a building, wherein the receiving opening may accept the expected package into the building. In some embodiments, the security panel may comprise a keypad. In some implementations, the security panel may be mechanical. In some aspects, the security panel may be digital. In some embodiments, the security panel may be connectable to a communications network.

In some implementations, the security panel may comprise a sensor mechanism. In some embodiments, the expected package may comprise an identification tag and the sensor mechanism may be configured to read the identification tag within a predefined proximity, wherein reading the identification tag of the expected package may unlock the locking mechanism for receipt of the expected package. In some aspects, the receiving opening may be accessible by a pet with an pet identification tag and the sensor mechanism may be configured to read the pet identification tag within a predefined proximity, wherein reading the pet identification tag of the pet may unlock the locking mechanism for access by the pet.

In some embodiments, the receiving module may further comprise a collapsible receptacle extending from the receiving opening. In some implementations, the collapsible receptacle may hold the expected package when received through the receiving opening. In some aspects, the collapsible receptacle may guide the expected package to a receiving location when received through the receiving opening. In some embodiments, the collapsible receptacle may engage when the expected package is received through the receiving opening.

In some aspects, the security panel may be programmable to receive an identification code for the expected package, wherein receiving the identification code may unlock the locking mechanism. In some implementations, the identification code may be active for a predefined length of time. In some embodiments, the identification code may unlock the locking mechanism for a predefined length of time. In some aspects, the identification code may be generated by a delivery service and transmitted wirelessly to the security panel. In some embodiments, a user may select the identification code manually through the security panel. In some implementations, the receiving module may be installable on a garage door of a garage, wherein the receiving opening may accept the expected package into the garage. In some aspects, the receiving module may further comprise the garage door. Implementations of the described techniques may comprise hardware, a method or process, or computer software on a computer-accessible medium.

BRIEF DESCRIPTION OF THE DRAWINGS

The accompanying drawings, that are incorporated in and constitute a part of this specification, illustrate several embodiments of the disclosure and, together with the description, serve to explain the principles of the disclosure.

DETAILED DESCRIPTION

Figure 1:
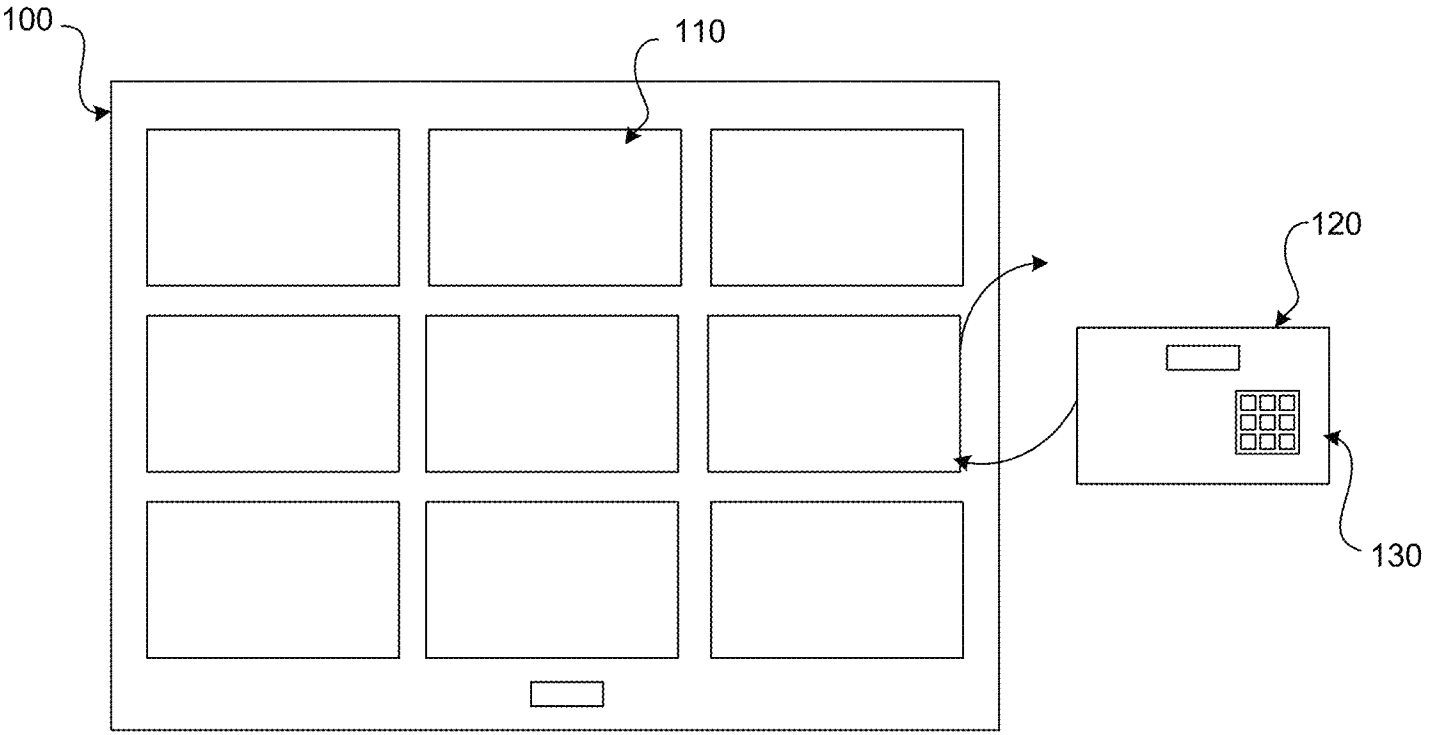
FIG. 1 illustrates an exemplary receiving module for installation in a garage door, according to some embodiments of the present disclosure.

The present disclosure provides generally for a system to receive deliveries. According to the present disclosure, a receiving module may allow for the secure delivery of packages without requiring the recipient to be present.

In the following sections, detailed descriptions of examples and methods of the disclosure will be given. The description of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

The present disclosure relates generally to a system and method for receiving packages through the mail when a person is not home. More specifically, the present disclosure provides a system for a person to facilitate safe and secure delivery to a receiving module without needing to be present. In some aspects, an administrator may control the module from a portable smart device or other wireless device. The receiving module may be operated digitally, manually, virtually, or combinations thereof. The settings of the receiving module may be controlled by a recipient, delivery service, sender, or combinations thereof. In some embodiments, the receiving module may be installable on a garage door.

In the following sections, detailed descriptions of examples and methods of the disclosure will be given. The description of both preferred and alternative examples, though thorough, are exemplary only, and it is understood that, to those skilled in the art, variations, modifications, and alterations may be apparent. It is therefore to be understood that the examples do not limit the broadness of the aspects of the underlying disclosure as defined by the claims.

Glossary

Receiving Module: as used herein refers to a mechanism that allows for secure delivery of packages when a person may not be able to receive the package. May also store objects or personal items; for a personal pick-up from a friend or family member.

Package: as used herein refers to any delivery.

Expected Package: as used herein refers to an expected delivery. In some aspects, the expectation for delivery may occur when a recipient orders a product. In some embodiments, such as with a gift, the expectation for delivery may occur when the package is being delivered and the recipient grants access for that delivery.

Code (or Identification Code or Access Code): as used herein refers to any security panel input that may unlock a locking mechanism of a receiving module. In some aspects, the code may be directly input on the security panel. In some embodiments, the code may be embedded in an object, such as an identification tag or label, wherein "reading" the object may input the code. In some implementations, the reading may occur manually, such as by scanning the object. In some aspects, the reading may occur automatically, such as based on proximity of the object to the security panel.

Referring now to FIG. 1, a garage door 100 and exemplary receiving module 120 are illustrated. In some aspects, the garage door 100 may comprise removable door panels 110. In some embodiments, the receiving module 120 may comprise a security panel 130. In some implementations, the receiving module may also comprise a hinge-like handle to open and close the module securely. In some embodiments, the security panel 130 may comprise of a keypad containing alphanumeric characters or images.

In some aspects, the security panel 130 may be programmed with a unique code. The code may be manually changed periodically. For example, an owner may change the code prior to or after each expected delivery. In some embodiments, an owner may not expect a package, such as when a gift is sent. In some implementations, the security panel 130 may comprise contact information or a paging function, which may alert the user of an unexpected delivery. In response, a user may directly provide the delivery person with a code.

In some embodiments, a user may create a profile and connect their phone number with a universal number, which may limit exposure of personal information. In some aspects, a unique extension or phone number may be associated with a user profile or address. In some embodiments, each delivery company or distributor may be associated with an identification number that may be sent to the user, which may ensure the person requested an access code is from a legitimate source. As an illustrative example, a delivery person may text an identification number associated with the package to a phone number listed on the receiving module 120. In some embodiments, the access code may be automatically transmitted back to the delivery person. In some aspects, the user may manually transmit the access code.

In some embodiments, a receiving module 120 may be mounted to a range of fixtures, such as a garage door, building front, or mailbox, as non-limiting examples. In some aspects, the receiving module 120 may serve as a temporary storage device. For example, a neighbor may need to borrow a hammer, and the user may not feel comfortable leaving the item out. The user may place the hammer in the receiving module 120 and give the neighbor an access code. As another example, the receiving module 120 may temporarily store a key more securely than leaving a key under the mat.

The receiving module 120 may be connected to a different service centers for different users to be in control of each of their own individual module. In some embodiments, service centers may manage multiple receiving modules 120, wherein an individual may not be responsible for responding to each delivery. In some aspects, an individual may work with the service center to establish the parameters of the relationship, such as who sets the codes, which delivery companies are automatically acceptable, which delivery companies require permissions, and who would respond to delivery requests, as non-limiting examples.

Figure 2:
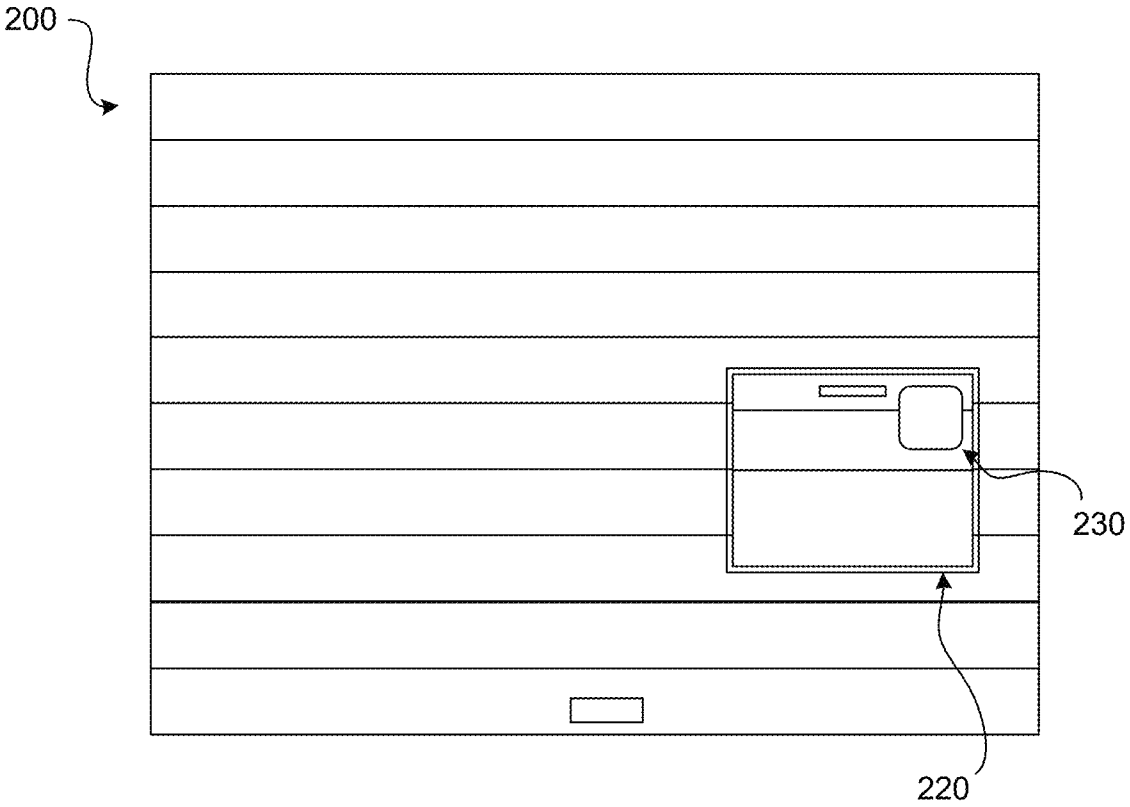
FIG. 2 illustrates an exemplary receiving module mounted on a garage door, according to some embodiments of the present disclosure.

Referring now to FIG. 2, a garage door 200 and exemplary receiving module 220 are illustrated. In some embodiments, the garage door 200 may be manufactured to include the receiving module 220. In some aspects, the garage door 200 and the receiving module 220 may be installed as a unit. In some implementations, the receiving module 220 may be offered as an optional feature of the garage door 200, wherein the feature may be selected before or after manufacture. For example, a garage door 200 may be manufactured with at least a portion of the receiving module 220, such as the receiving opening and the frame to accept a receiving panel and security panel that may be installed with the garage door 200. In some embodiments, the security panel may be installed separately and may be customizable. For example, a user may be able to select the type of security panel or at least some of the features, such as a mechanical lock, digital display, wireless capabilities, sensing capabilities, or setting options, as non-limiting examples.

Figure 8:
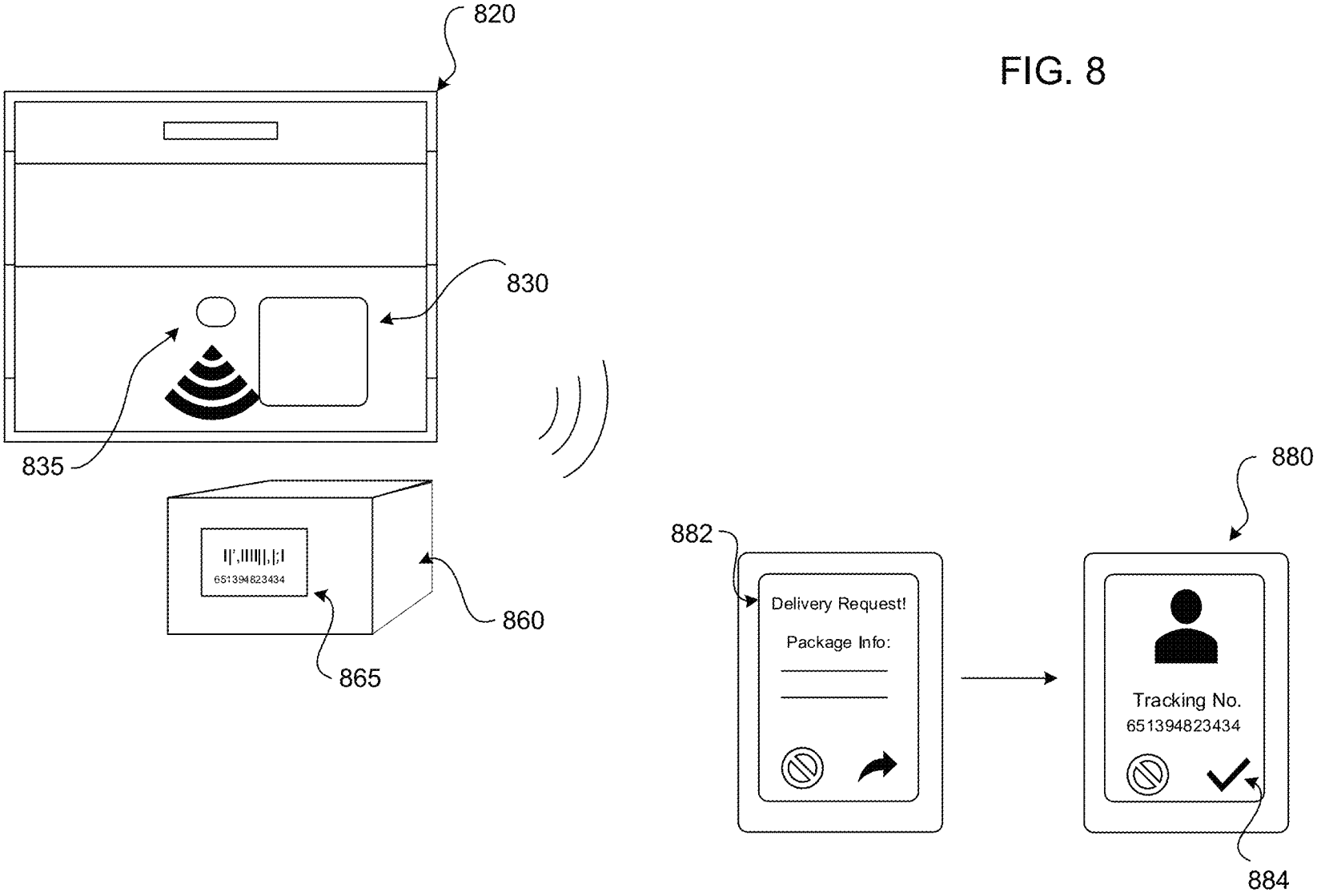
FIG. 8 illustrates an exemplary receiving module communication system, according to some embodiments of the present disclosure.

In some implementations, the receiving module 220 may comprise a security display panel 230. In some aspects, the access code on the security panel 230 may be changed daily, hourly, or pertain to specific packages. In some embodiments, the receiving module 220 may comprise a camera or scanner (such as illustrated in FIG. 8), which may scan individual barcodes for delivery. In some implementations, the camera may notify a smart device when motion is detected, so that a delivery can be executed.

In some aspects, the receiving module 220 may be programmed to change the code periodically, wherein the new code may be randomly generated or the user may be prompted to change the code manually. In some embodiments, when a delivery request may be received, the receiving module 220 may prompt the user to input a new identification code specific to the delivery request. Creating single-use identification codes may reduce the chance of break in or security breach from deliberate of accidental sharing of the code. In some aspects, delivery may require a confirmation from the recipient to open the receiving module. In some implementations, the receiving module 220 may comprise a camera or scanner that could capture delivery information, such as from a label or a photo of the delivery person).

In some aspects, the identification code may only be active for a predefined length of time, which may be determined manually or automatically. For example, an expected package may have a set delivery date and time range, and the code associated with the expected package may be active during that range only. The range may be general, such as a range of days, or narrow, such as a range of hours. Some delivery tracking systems monitor the location of the package more precisely than others, and the level of precision may partially determine a practical predefined length of time. As another example, such as where the recipient is a place of business, the code may only be active when the business is closed, otherwise, the recipient may want the delivery inside.

In some implementations, a code may unlock the locking mechanism for a limited amount of time, which may limit access after the delivery. For example, input of an identification code may unlock the receiving panel for sixty seconds, which may be enough time to insert the package but not long enough for a thief or passerby to open it unnoticed after the delivery. In some aspects, a secondary alert system may notify a recipient if the receiving panel is open for an extended amount of time, which may indicate an unauthorized person is attempting to access the package or anything beyond the receiving opening. As an illustrative example, the secondary alert system may beep to warn a deliverer that the time to open, close, or both the receiving panel is closing, and the recipient may be notified if the receiving panel is still open after that predefined time. In some aspects, the code may unlock the locking mechanism once, wherein once the receiving panel is closed after an initial opening, the code no longer works. In some embodiments, a deliverer may manually request a refreshed or new code if the original code expires or they accidently close the door before inserting the expected package.

Figure 3:
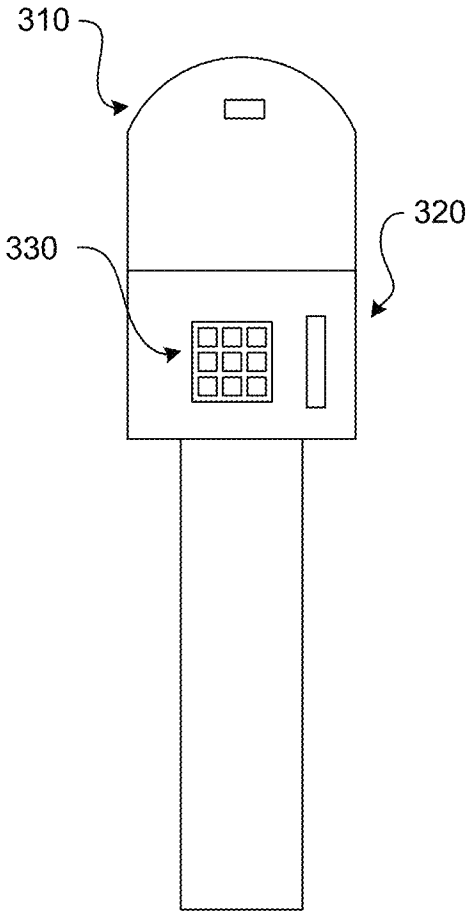
FIG. 3 illustrates an exemplary receiving module attached on the underside of a mailbox.

Referring now to FIG. 3, a mailbox 310 with an exemplary receiving module 320 is illustrated. In some aspects, the receiving module 320 may be tailored to the size of a mailbox, and the security panel 330 may be scaled accordingly. In some implementations, the security panel 330 may be mechanical, wherein a power source may not be required, which may be convenient where the receiving module 320 may be mounted to a fixture detached from the building.

In some implementations, the receiving module 320 may be mounted on the underside of the mailbox. In some embodiments, the security panel 330 may comprise a detachable mechanism for removal. In some aspects, a detachable mechanism may allow for recharging of the receiving module 320. In some implementations, the security panel 330 may be rechargeable and the receiving module 320 may comprise a solar power collector, which may charge the security panel 330.

Figure 4:
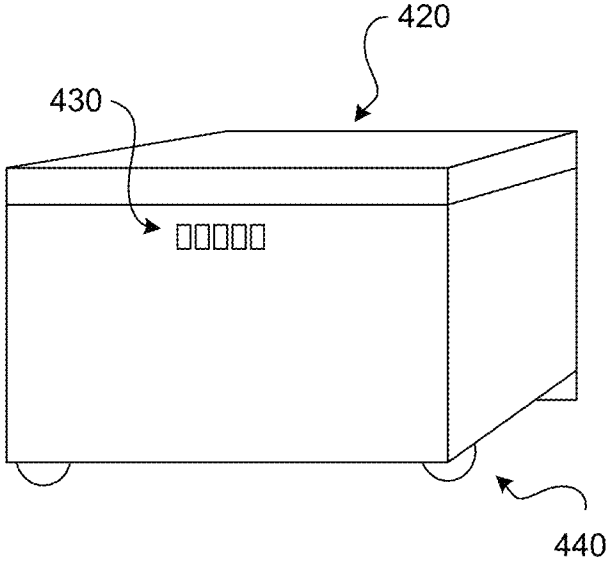
FIG. 4 illustrates an exemplary free-standing receiving module, according to some embodiments of the present disclosure.

Referring now to FIG. 4, an exemplary independent receiving module 420 is illustrated. In some embodiments, the receiving module 420 may be free standing, wherein the receiving module 420 may not be mounted to a fixture. In some implementations, a free-standing receiving module 420 may be portable, which may allow the user to place it wherever may be convenient. For example, a user may periodically change their landscape or seasonal décor and being able to move the receiving module 420 may allow for more flexibility.

In some aspects, the security panel 430 may be located on, but not limited to, the front side of the receiving module 430, such as topside, left or right side, as non-limiting examples. In some aspects, the receiving module 420 may comprise separate compartments to receive different deliveries of different sizes. In some embodiments, the code on this security panel 430 may have different codes for each compartment, wherein each code may unlock only the individual compartment.

In some embodiments, the receiving module may comprise a portability mechanism 440 on the underside. In some aspects, the portability mechanism may comprise wheels, tracks, or any other form of transportation, as non-limiting examples. In some implementations, the portability mechanism 440 may comprise a locking system, wherein the receiving module 420 may be stable on slippery surfaces or slopes. In some embodiments, the receiving module 420 may be controlled manually from a portable smart device for transportation using the portability mechanism 440. In some aspects, the receiving module 420 may be free standing in a specific location.

In some embodiments, at least a portion of the receiving module 420 may comprise a refrigerated compartment, which may allow for the temporary storage of perishables. For example, meal services that deliver perishable ingredients or fully cooked meals may require refrigeration. Often, the perishables are shipped with dry ice, which may keep the package cool for a limited time. If the recipient arrives home late or even the next day, the perishables may spoil. Delivery into a refrigerated compartment may allow for longer safe storage.

Figure 5:
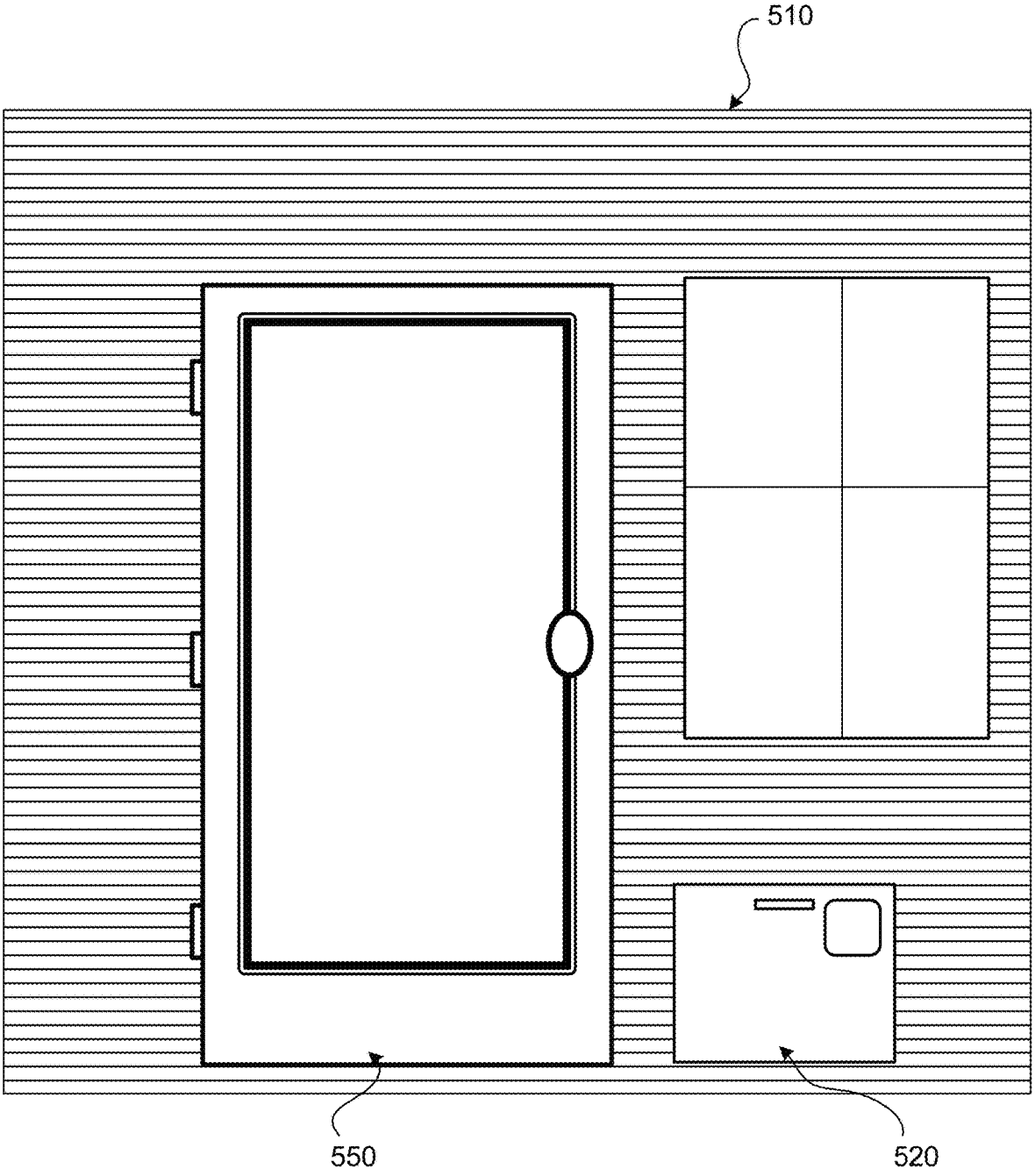
FIG. 5 illustrates an exemplary receiving module installed on a building front, according to some embodiments of the present disclosure.

Referring now to FIG. 5, an exemplary building front 510 with receiving module 520 is illustrated. In some embodiments, the receiving module 520 may comprise an exterior door and an interior door, wherein the exterior door may comprise the a security panel. In some implementations, the interior door may provide access to the receiving module 520. In some aspects, the receiving module 520 may be used residentially or commercially.

In some embodiments, an interior door may comprise a secondary security panel, which may limit access to those who may have permission to retrieve deliveries. In some aspects, a receiving module 520 may be programmed to be unlocked at certain hours. In some implementations, the receiving module 520 may be installed into the building based on specifications.

Figure 6C:
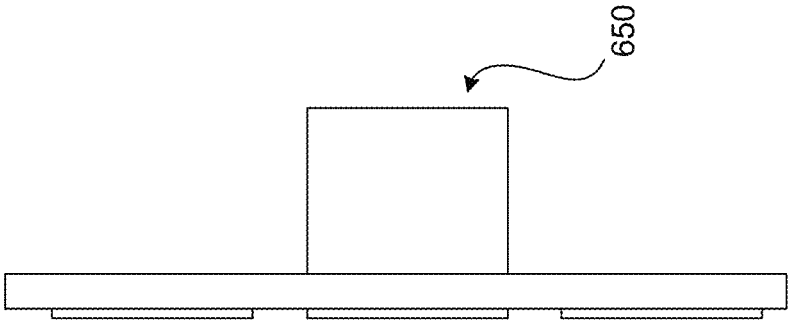
FIG. 6C illustrates an exemplary receiving module as an enclosure wherein a package may rest inside the module.
Figure 6B:
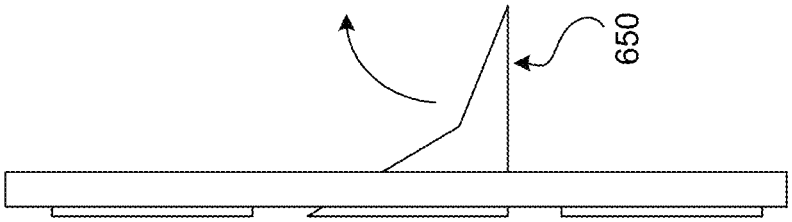
FIG. 6B illustrates an exemplary receiving module unfolded, wherein the unfolded receiving module may hold one or more packages.
Figure 6A:
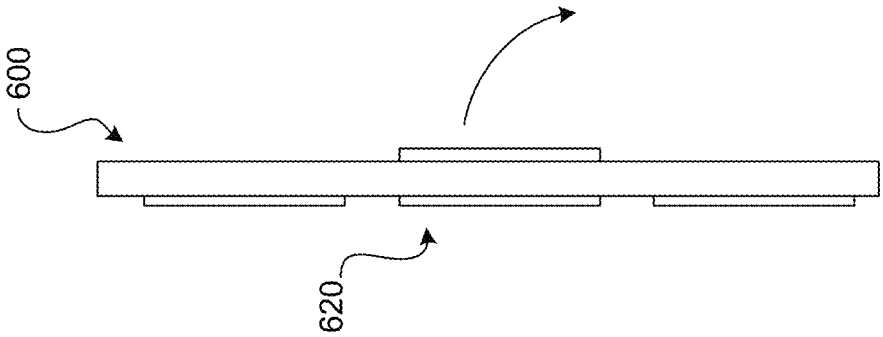
FIG. 6A illustrates an exemplary receiving module flush with the garage door allowing for free operation of the garage door.
Figure 7D:
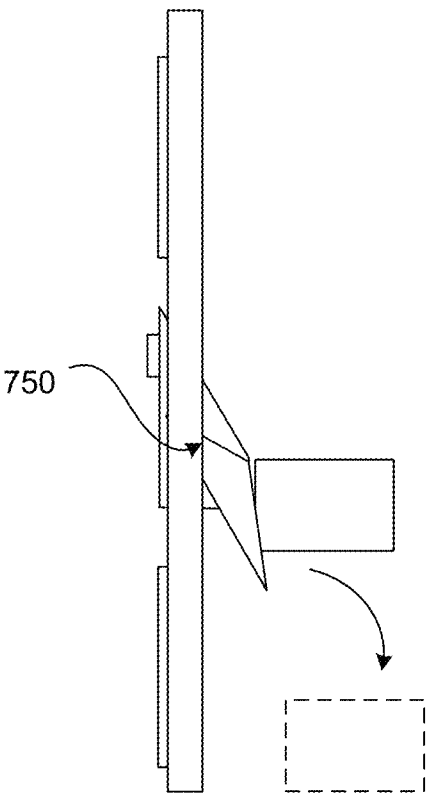
FIG. 7D illustrates an exemplary receiving module with a hinged receptacle dropping a received package, according to some embodiments of the present disclosure.
Figure 7C:
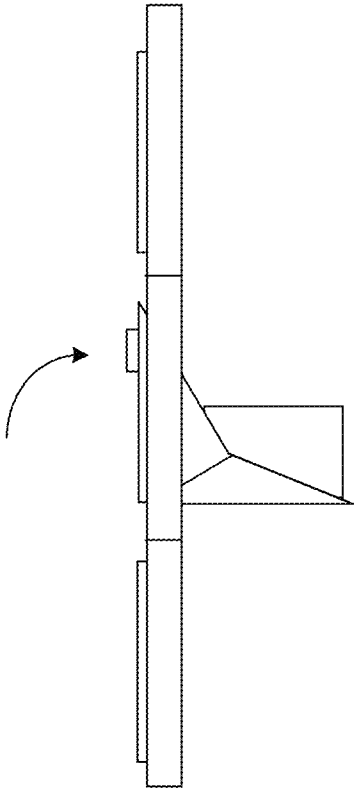
FIG. 7C illustrates an exemplary receiving module with a hinged receptacle receiving a package.
Figure 7B:
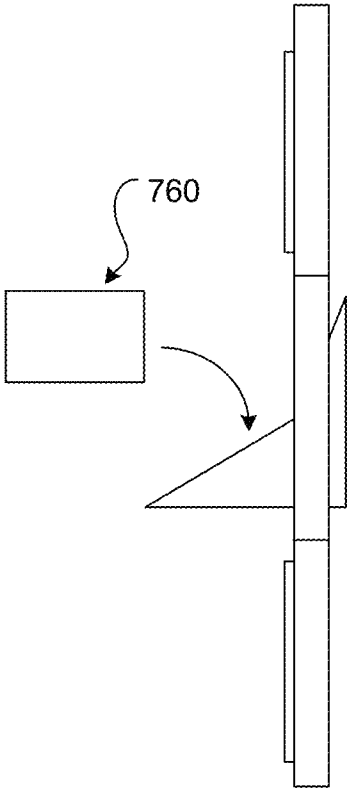
FIG. 7B illustrates an exemplary receiving module with a hinged receptacle receiving a package, according to some embodiments of the present disclosure.
Figure 7A:
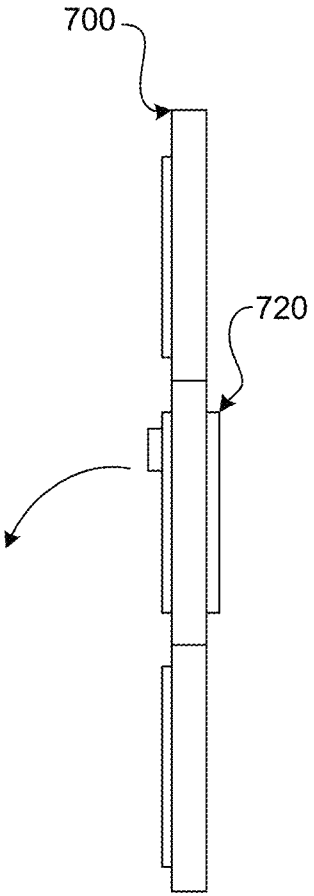
FIG. 7A illustrates an exemplary receiving module on the garage door with a hinged receptacle, according to some embodiments of the present disclosure.

Referring now to FIGS. 6A-6C, exemplary unfolding steps of a collapsible receptacle 650 of a receiving module 620 are illustrated. In some aspects, the receiving module 620 may hinder the ability of the garage door 600 to go up when the collapsible receptacle 650 is unfolded. In some embodiments, the collapsible receptacle 650 may automatically unfold to hold the package when a security code is typed in. In some implementations, the collapsible receptacle 650 may be manually unfolded when a package is place in the receiving module 620. In some aspects, the collapsible receptacle 650 may hold up to a certain weight limit. In some embodiments, the collapsible receptacle 650 may inhibit a delivery person from reaching into the receiving module 620. In some aspects, the collapsible receptacle 650 may be manually unlocked or unfolded by the recipient when they may expect a package.

Referring now to FIGS. 7A-7D, exemplary steps for delivering a package 760 through a receiving module 720 are illustrated. In some embodiments, a hinged receptacle 750 may allow the package to slide off the receiving module 720 more delicately than a normal drop, which may particularly useful for breakable contents. In some aspects, the hinged receptacle 750 may rehinge after a delivery has been accepted, allowing the garage door 700 to open safely without damaging the delivery.

In some implementations, the hinged receptacle 750 may be controlled manually from a smart device. In some aspects, the hinged receptacle 750 may retain the package, which may be beneficial for fragile contents. In some embodiments, the hinged receptacle 750 may automatically remain engaged if a package meets certain threshold parameters, such as weight or size. In some implementations, the hinged receptacle 750 may remain engaged where the delivery person may indicate that the package is stamped fragile. In some aspects, the hinged receptacle 750 may remain engaged where the user may request it. In some embodiments, the hinged receptacle 750 may swivel from outside to inside, which may inhibit intruders from entering the garage and prevent unauthorized access to the delivered packages. The hinged receptacle 750 may remain in a locked position until the recipient is notified of a delivery or a code is typed in to a security panel.

Referring now to FIG. 8, exemplary steps for delivering and receiving an expected package 860 through a receiving module 820. In some aspects, a camera or scanner 835 in logical communication with the security panel 830 may be used to verify a delivery by scanning a label or barcode 865 associated with a package. In some embodiments, the camera or scanner 835 may also detect motion and let the recipient know when there is a delivery or such movement in front of the receiving module 820. In some implementations, the receiving module 820 may be paired with a computing device 880 of the recipients' choice, such as a smartphone, tablet, or laptop.

In some aspects, a notification may be received 882 by the recipient. As non-limiting examples, the notifications may indicate a movement near the receiving module 820, package delivery, or a security threat. In some embodiments, the recipient may allow or deny the delivery of a package 884 using their computing device 880. In some aspects, the delivery prompt may include a photograph of the delivery person as an added security measure.

The module may lock and unlock manually from the users' phone, or in person, and may as well be unlocked at the discretion of the user based on the camera/scanner 835. The camera/scanner 835 may also have the ability to scan barcodes of a package. The module may be programmed to recognize each individual package before the package arrive. In some embodiments, where a user may be ordering an item for delivery to their own place, the user may input a delivery code for the delivery company, wherein the code may be printed on the package label or embedded in the SKU. In some implementations, where the code may be embedded in the SKU, scanning the SKU may automatically input the code and unlock the receiving module 820.

In some aspects, the receiving module 820 may pair with authorized portable devices within a predefined range. For example, official portable devices associated with delivery companies may be authorized to receive access codes. In some embodiments, the receiving module 820 may indicate to the recipient that a package has been delivered. For example, the receiving module 820 may comprise lighting that may be a predefined color or intensity based on its status, such as empty, delivery on ground, or delivery on hinged receptacle. In some embodiments, the notifications may be programmable. In some implementations, the receiving module 820 may transmit a reminder notification to a portable device associated with the user's profile when the portable device is detected within a predefined range.

Figure 9:
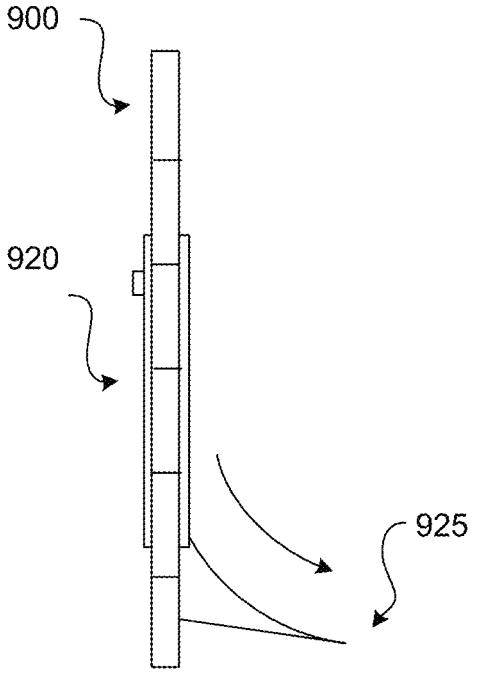
FIG. 9 illustrates an exemplary receiving module with package guide, according to some embodiments of the present disclosure.

Referring now to FIG. 9, an exemplary receiving module 920 with package guide 925 is illustrated. In some aspects, a delivery may be inserted through the receiving module 920 and then slide down the package guide 925, which may reduce the impact of dropping to the ground. In some embodiments, the package guide 925 may be inserted by the recipient for delicate packages.

In some implementations, the package guide 925 may be removed or collapsed manually to ensure that the garage door 900 may resume normal use. In some embodiments, the package guide 925 may collapse or spring back into a folded position once a package has been placed. In some aspects, the package guide 925 may latch to the receiving module to ensure support.

Figure 10:
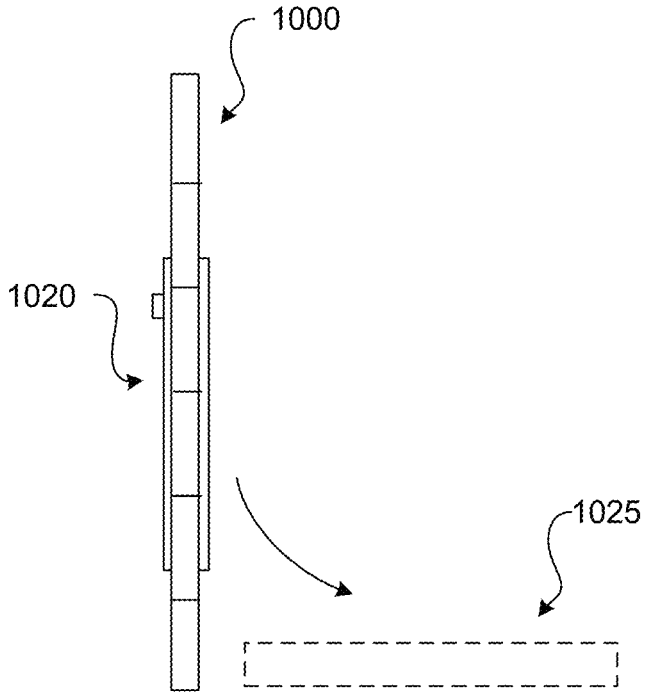
FIG. 10 illustrates an exemplary receiving module with a package platform, according to some embodiments of the present disclosure.

Referring now to FIG. 10, a garage door 1000 with an exemplary receiving module 1020 with package platform 1025 is illustrated, wherein the package platform 1025 may reduce damage from dropping a package through the receiving module 1020. In some aspects, a package platform 1035 may ensure that when a package is received through the receiving module 1020 the package may drop onto a package platform 1025, which may brace the fall of the delivery. In some embodiments, the package platform 1025 may comprise a protective material to ensure the safety of the delivery, such as soft cloth padding, gel padding, rubber padding, or combinations thereof, as non-limiting examples.

In some aspects, the package platform 1025 may be integrated into the garage floor, which may be less obtrusive to the path. In some implementations, the package platform 1025 may be removed manually when not in use. In some aspects, the package platform 1025 may be paired with a package guide, such as illustrate in FIG. 9, which may provide extra assurance that that the delivery will not be damaged or damage the area proximate to the delivery.

In some embodiments, the receiving module may allow for a mail carrier to deliver a package(s) to a user that may not be present at the time. This may save the user time from taking a separate trip to the destination of their package(s) if they were not present in any other scenario. In some aspects, the receiving module may hold multiple packages depending on the configuration of the receiving module. For example, where the receiving module may hold the package, the number and size of the delivery may be limited to the size of the receiving module. Wherein the receiving module drops the package to the ground, the number and size of the delivery may be more varied.

Figure 11A:
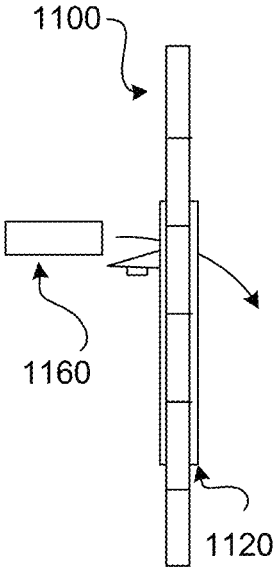
FIG. 11A illustrates an exemplary adaptable receiving module, according to some embodiments of the present disclosure.
Figure 11B:
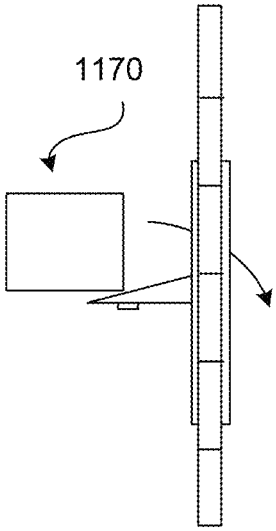
FIG. 11B illustrates an exemplary adaptable receiving module, according to some embodiments of the present disclosure.
Figure 11C:
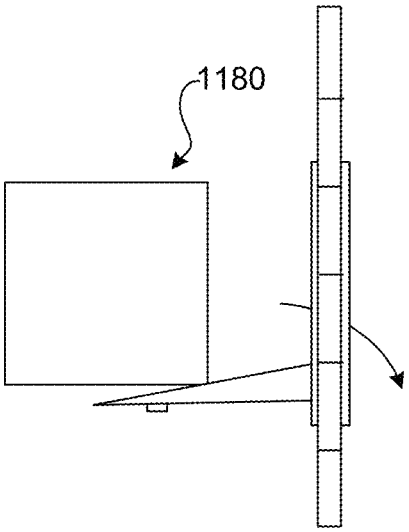
FIG. 11C illustrates an exemplary adaptable receiving module, according to some embodiments of the present disclosure.

Referring now to FIGS. 11A-11C, an exemplary adaptable receiving module 1120 with variable delivery ports is illustrated, wherein the delivery ports may limit access based on a package size. In some embodiments, an adaptable receiving module 1120 may will allow for the secure delivery of different sized packages (small package 1160, medium package 1170, or larger package 1180). In some aspects, the garage door 1100 may compromise tiered delivery access.

In some implementations, a small slot located on the adaptable receiving module 1120 may receive a small package 1160 or secure mail, such as certified letters. In some embodiments, a medium size package slot may receive a medium package 1170. In some embodiments, adaptable receiving module 1120 may comprise a large package door for a large package 1180. In some aspects, the adaptable receiving module 1120 may consist of shelving place holders to store a delivery in its own compartment. For example, a shelf may separate the small package 1160 in its own space. In some implementations, the adaptable receiving module 1120 may provide different compartments to separate multiple deliveries at once, and the shelves on the interior of the adaptable receiving unit 1120 may be manually or automatically removed to store a large package 1180.

Figure 12A:
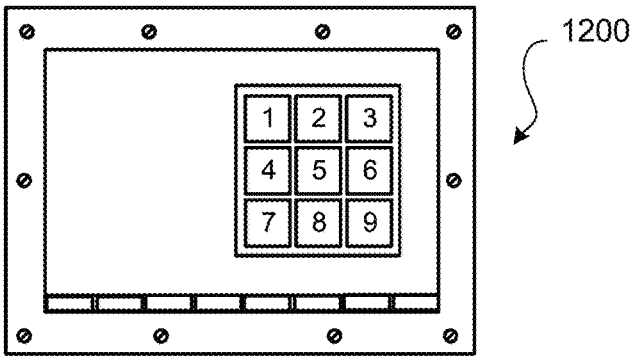
FIG. 12A illustrates an exemplary receiving module, according to some embodiments of the present disclosure.

Referring now to FIG. 12A, an exemplary receiving module 1200 is illustrated. In some aspects, the receiving module 1200 may comprise a bottom hinge, which may allow the door to pull down. In some embodiments, the receiving module 1200 may comprise a number security panel, which may comprise a digital or mechanical input system.

Figure 12B:
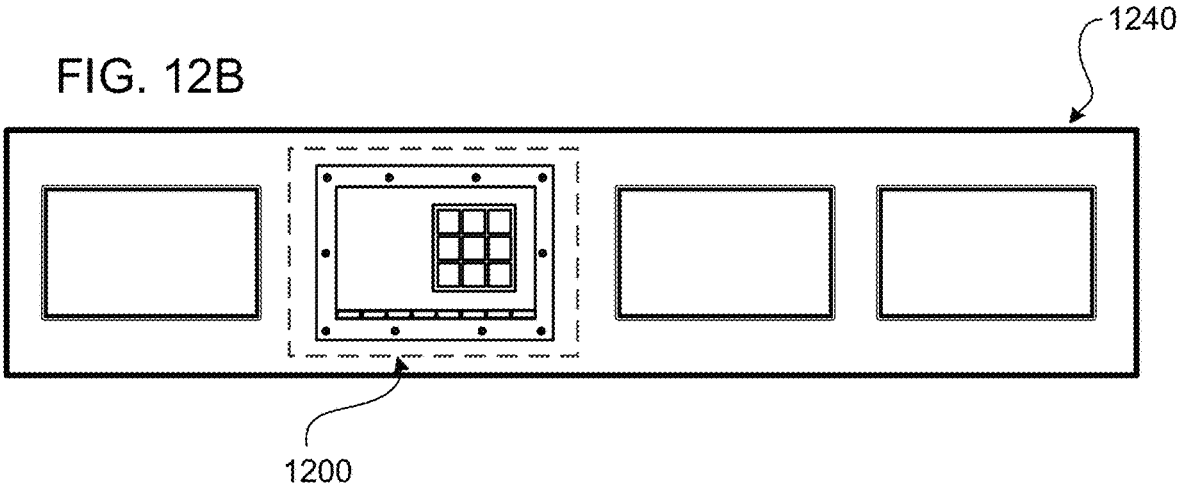
FIG. 12B illustrates a garage segment with an exemplary receiving module, according to some embodiments of the present disclosure.

Referring now to FIG. 12B, a segment of a garage door 1240 with an exemplary receiving module 1200 is illustrated. In some implementations, the receiving module 1200 may replace a panel within a garage door 1240. In some embodiments, the receiving module 1200 may be pre-installed within the garage door 1240, wherein installation of the garage door 1240 may include the receiving module 1200. In some aspects, the receiving module 1200 may be integrated into the garage door 1240 post manufacture, such as by removing a panel from the garage door 1240.

In some implementations, the receiving module 1200 may comprise a similar façade as those of the surrounding panels, which may allow the receiving module 1200 to blend in. The material may comprise a durable material, which may allow the receiving module 1200 to withstand the elements. In some aspects, the door of the receiving module 1200 may be customizable depending on the dimensions and location of the receiving module 1200 within garage door 1240. In some embodiments, the door may be sliding, and the door may click into an open position to allow for easy delivery. In some implementations, the receiving module 1200 may comprise a sensor that may detect once a package has been delivered and automatically close the door to prevent access to the package.

Figure 12C:
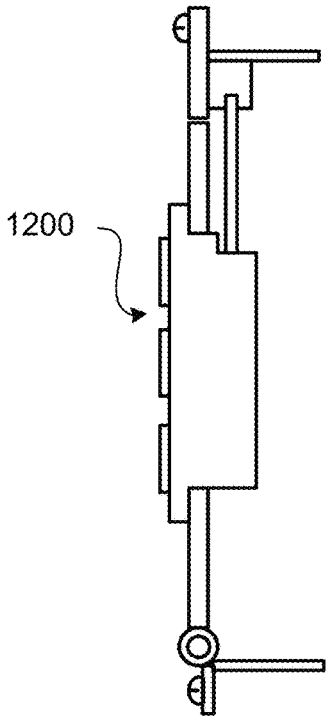
FIG. 12C illustrates a side view of an installed exemplary receiving module, according to some embodiments of the present disclosure.

Referring now to FIG. 12C, a side view of an installed exemplary receiving module 1200 is illustrated. In some embodiments, the receiving module 1200 may comprise a lever locking mechanism, which may release when the correct code is entered into the security panel. In some aspects, a portion of the receiving module 1200 may be directly connected to the garage door. In some implementations, the receiving module 1200 may be self-contained, which may allow a receiving module 1200 to be inserted into the garage door or other appropriate opening.

Referring now to FIGS. 13A-13D, exemplary steps for a pet 1330 activating a receiving module 1320 are illustrated. In some aspects, the receiving module 1320 may comprise a security panel with a sensor mechanism, such as RFID, IR, NFC, or other sensing technology. In some embodiments, the sensor mechanism may be in logical communication with a processor that may receive programming instructions either directly through the security panel or wirelessly from external devices. In some implementations, the programming instructions may identify unique identification numbers (UIN) or codes associated with tags on expected packages and permissible pets.

Figures 13A, 13B, 13C, 13D:
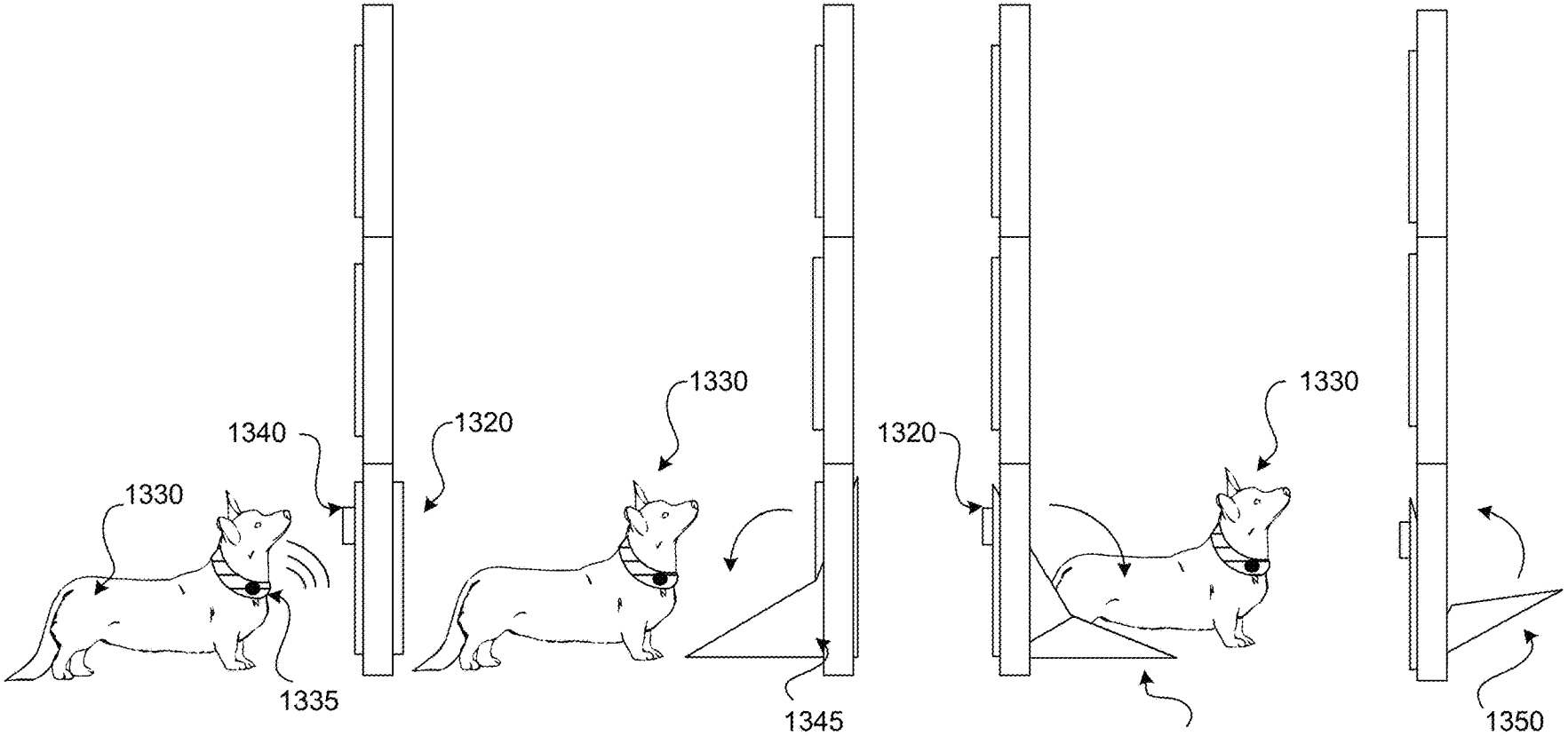
FIG. 13A illustrates an exemplary receiving module on a garage door with a wireless pet sensor detecting a pet, according to some embodiments of the present disclosure.
FIG. 13B illustrates an exemplary receiving module releasing a pet door, according to some embodiments of the present disclosure.
FIG. 13C illustrates a pet walking through an exemplary receiving module with a hinged receptacle.
FIG. 13D illustrates an exemplary receiving module with a resetting hinged receptacle, according to some embodiments of the present disclosure.

In some aspects, the UIN for each expected package may be uploaded in anticipation of receipt, such as by a sender, a delivery company, or the recipient. In some implementations, the UIN permission may be temporary, such as within two days of the expected delivery, before, after, or both. In some aspects, the UIN permission may be confirmed by the recipient to limit fraudulent upload of UINs. In some embodiments, the tag may be embedded in the package, such as on a label, in the walls of the box, or on an inner object. For pets, the tags may be embedded on a collar or embedded into their skin.

Where the receiving module 1320 may allow for passage of a pet 1330, the receiving module 1320 may be installed close to floor level to allow a pet 1330 to step through. In some embodiments, the receiving module 1320 may be installed on a garage, exterior wall, or exterior door, as non-limiting examples, wherein a pet 1330 may pass through a receiving opening and enter an interior portion of a building. In some implementations, such as illustrated in FIG. 13A, a sensor on a security panel 1340 of a receiving module 1320 may detect a tag 1335 of a pet 1330 within a predefined proximity. At FIG. 13B, a front panel 1345 of the receiving module 1320 may release and drop down allowing the pet 1330 to enter into a receiving opening.

At FIG. 13C, to limit access to anyone other than the pet 1330, the pet 1330 may push down a back panel 1350 as the pet 1330 walks through the receiving opening into the interior, wherein pushing down the back panel 1350 may mechanically pull up or trigger the front panel 1345 to close. As FIG. 13D, once the pet 1330 walks through the receiving opening, the back panel 1350 may close. In some implementations, having two separate panels may increase the security of the receiving module 1320. In some aspects, the panels may operate differently for an expected package than a pet 1330. In some embodiments, with an expected package, the delivery person may need to take specific actions to operate the receiving module 1320, such as manually open the front panel 1345, open a separate delivery panel, or input credentials or additional codes, as non-limiting examples.

In some implementations, the receiving module 1320 may comprise two sets of panels, wherein operation of one set may be triggered by a pet 1330 and the operation of the second set may be triggered by an expected package. Separate operating systems may allow for each system to be configured to each set of security needs. For example, different safety mechanisms may need to be in place for a pet 1330 than for the package. In some aspects, a confirmation mechanism may allow for secondary security. For example, detection of a pet 1330 with a tag 1335 may prompt transmission of a pet entry confirmation to the recipient or resident of the home. The secondary confirmation may allow the pet owner to confirm that no one is nearby or manipulating the pet 1330 to gain access.

Figure 14:
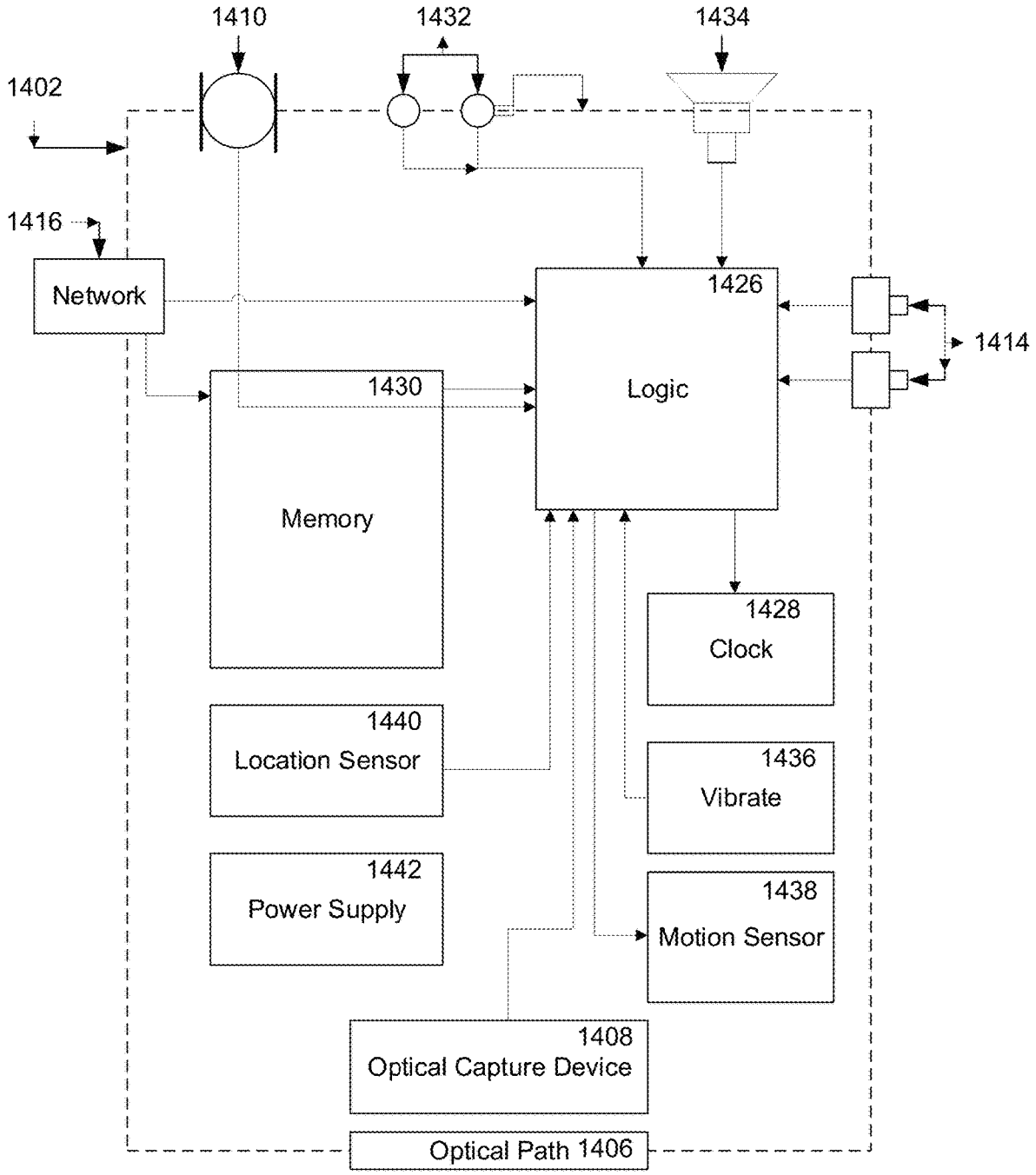
FIG. 14 illustrates an exemplary block diagram of an exemplary embodiment of a mobile device, according to some embodiments of the present disclosure.

Referring now to FIG. 14, an exemplary block diagram of an exemplary embodiment of a mobile device 1402 is illustrated. The mobile device 1402 may comprise an optical capture device 1408, which may capture an image and convert it to machine-compatible data, and an optical path 1406, typically a lens, an aperture, or an image conduit to convey the image from the rendered document to the optical capture device 1408. The optical capture device 1408 may incorporate a Charge-Coupled Device (CCD), a Complementary Metal Oxide Semiconductor (CMOS) imaging device, or an optical sensor of another type.

In some embodiments, the mobile device 1402 may comprise a microphone 1410, wherein the microphone 1410 and associated circuitry may convert the sound of the environment, including spoken words, into machine-compatible signals. Input facilities 1414 may exist in the form of buttons, scroll-wheels, or other tactile sensors such as touchpads. In some embodiments, input facilities 1414 may include a touchscreen display. Visual feedback 1432 to the user may occur through a visual display, touchscreen display, or indicator lights. Audible feedback 1434 may be transmitted through a loudspeaker or other audio transducer. Tactile feedback may be provided through a vibration module 1436.

In some aspects, the mobile device 1402 may comprise a motion sensor 1438, wherein the motion sensor 1438 and associated circuitry may convert the motion of the mobile device 1402 into machine-compatible signals. For example, the motion sensor 1438 may comprise an accelerometer, which may be used to sense measurable physical acceleration, orientation, vibration, and other movements. In some embodiments, the motion sensor 1438 may comprise a gyroscope or other device to sense different motions.

In some implementations, the mobile device 1402 may comprise a location sensor 1440, wherein the location sensor 1440 and associated circuitry may be used to determine the location of the device. The location sensor 1440 may detect Global Position System (GPS) radio signals from satellites or may also use assisted GPS where the mobile device may use a cellular network to decrease the time necessary to determine location. In some embodiments, the location sensor 1440 may use radio waves to determine the distance from known radio sources such as cellular towers to determine the location of the mobile device 1402. In some embodiments these radio signals may be used in addition to and/or in conjunction with GPS.

In some aspects, the mobile device 1402 may comprise a logic module 1426, which may place the components of the mobile device 1402 into electrical and logical communication. The electrical and logical communication may allow the components to interact. Accordingly, in some embodiments, the received signals from the components may be processed into different formats and/or interpretations to allow for the logical communication. The logic module 1426 may be operable to read and write data and program instructions stored in associated storage 1430, such as RAM, ROM, flash, or other suitable memory. In some aspects, the logic module 1426 may read a time signal from the clock unit 1428. In some embodiments, the mobile device 1402 may comprise an on-board power supply 1442. In some embodiments, the mobile device 1402 may be powered from a tethered connection to another device, such as a Universal Serial Bus (USB) connection.

In some implementations, the mobile device 1402 may comprise a network interface 1416, which may allow the mobile device 1402 to communicate and/or receive data to a network and/or an associated computing device. The network interface 1416 may provide two-way data communication. For example, the network interface 1416 may operate according to an internet protocol. As another example, the network interface 1416 may comprise a local area network (LAN) card, which may allow a data communication connection to a compatible LAN. As another example, the network interface 1416 may comprise a cellular antenna and associated circuitry, which may allow the mobile device to communicate over standard wireless data communication networks. In some implementations, the network interface 1416 may comprise a Universal Serial Bus (USB) to supply power or transmit data. In some embodiments, other wireless links known to those skilled in the art may also be implemented.

Figure 15:
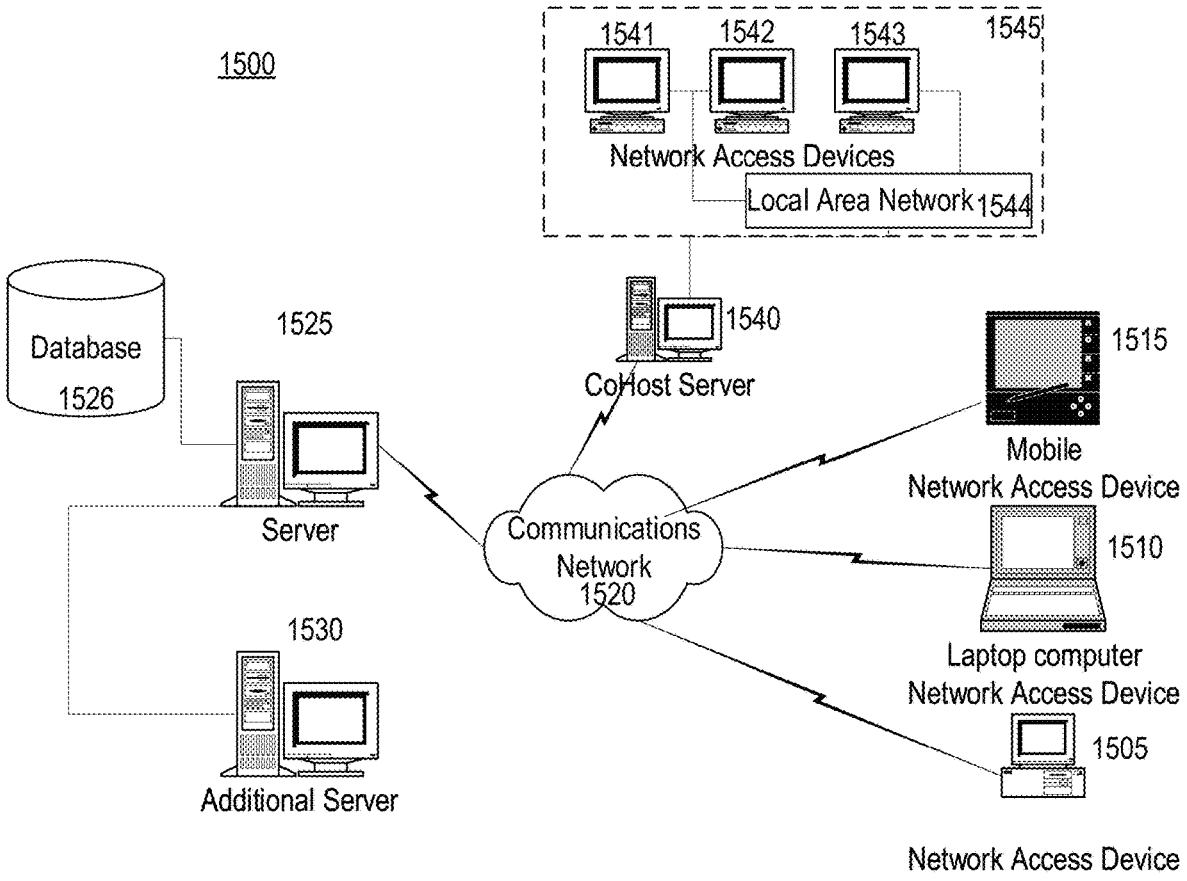
FIG. 15 illustrates an exemplary processing and interface system, according to some embodiments of the present disclosure.

Referring now to FIG. 15, an exemplary processing and interface system 1500 is illustrated. In some aspects, access devices 1515, 1510, 1505, such as a paired portable device 1515 or laptop computer 1510 may be able to communicate with an external server 1525 though a communications network 1520. The external server 1525 may be in logical communication with a database 1526, which may comprise data related to identification information and associated profile information. In some embodiments, the server 1525 may be in logical communication with an additional server 1530, which may comprise supplemental processing capabilities.

In some aspects, the server 1525 and access devices 1505, 1510, 1515 may be able to communicate with a cohost server 1540 through a communications network 1520. The cohost server 1540 may be in logical communication with an internal network 1545 comprising network access devices 1541, 1542, 1543 and a local area network 1544. For example, the cohost server 1540 may comprise a payment service, such as PayPal or a social network, such as Facebook or a dating website.

CONCLUSION

A number of embodiments of the present disclosure have been described. While this specification contains many specific implementation details, there should not be construed as limitations on the scope of any disclosures or of what may be claimed, but rather as descriptions of features specific to particular embodiments of the present disclosure.

Certain features that are described in this specification in the context of separate embodiments can also be implemented in combination or in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. A receiving module for receiving packages, the receiving module comprising:

a receiving opening for receiving an expected package;

a receiving panel, wherein the receiving panel controls access to the receiving opening;

a locking mechanism that secures the receiving panel, wherein when the receiving panel is secured, the receiving opening is not accessible;

a hinged receptacle that receives the expected package through the receiving opening, wherein the hinged receptacle is manually controllable by a smart device and the hinged receptacle is configured to:

drop the expected package, wherein dropping occurs based in part on threshold parameters of the expected package, and reset after dropping the expected package;

a collapsible receptacle extending from the receiving opening to the hinged receptacle, wherein the collapsible receptacle guides the expected package to the hinged receptacle when received through the receiving opening; and a security panel that controls the locking mechanism.

2. The receiving module of claim 1, wherein the receiving module is installable on an exterior wall of a building, wherein the receiving opening accepts the expected package into the building.

3. The receiving module of claim 1, wherein the security panel comprises a keypad.

4. The receiving module of claim 1, wherein the security panel is mechanical.

5. The receiving module of claim 1, wherein the security panel is digital.

6. The receiving module of claim 1, wherein the security panel is connectable to a communications network.

7. The receiving module of claim 1, wherein the security panel comprises a sensor mechanism.

8. The receiving module of claim 7, wherein the expected package comprises an identification tag and the sensor mechanism is configured to read the identification tag within a predefined proximity, wherein reading the identification tag of the expected package unlocks the locking mechanism for receipt of the expected package.

9. The receiving module of claim 7, wherein the receiving opening is accessible by a pet with an pet identification tag and the sensor mechanism is configured to read the pet identification tag within a predefined proximity, wherein reading the pet identification tag of the pet unlocks the locking mechanism for access by the pet.

10. The receiving module of claim 1, wherein the collapsible receptacle and the hinged receptacle holds the expected package when received through the receiving opening.

11. The receiving module of claim 1, wherein the collapsible receptacle engages when the expected package is received through the receiving opening.

12. The receiving module of claim 1, wherein the security panel is programmable to receive an identification code for the expected package, wherein receiving the identification code unlocks the locking mechanism.

13. The receiving module of claim 12, wherein the identification code is active for a predefined length of time.

14. The receiving module of claim 12, wherein the identification code unlocks the locking mechanism for a predefined length of time.

15. The receiving module of claim 12, wherein the identification code is generated by a delivery service and transmitted wirelessly to the security panel.

16. The receiving module of claim 12, wherein a user selects the identification code manually through the security panel.

17. The receiving module of claim 1, wherein the receiving module is installable on a garage door of a garage, wherein the receiving opening accepts the expected package into the garage.

18. The receiving module of claim 17, further comprising the garage door.

* * * * *